US010688363B2

(12) United States Patent
Rohner

(10) Patent No.: US 10,688,363 B2
(45) Date of Patent: Jun. 23, 2020

(54) BODY ALIGNMENT TOOL FOR SWIMMERS

(71) Applicant: Patricia Anne Rohner, Raleigh, NC (US)

(72) Inventor: Patricia Anne Rohner, Raleigh, NC (US)

(73) Assignee: Patricia A. Rohner, Raleigh, NC (US)

( * ) Notice: Subject to any disclaimer, the term of this patent is extended or adjusted under 35 U.S.C. 154(b) by 177 days.

(21) Appl. No.: 15/884,989

(22) Filed: Jan. 31, 2018

(65) Prior Publication Data

US 2019/0232140 A1 Aug. 1, 2019

(51) Int. Cl.

| | |
|---|---|
| ***A63B 69/12*** | (2006.01) |
| ***A63B 31/00*** | (2006.01) |
| ***A63B 69/14*** | (2006.01) |
| *A63B 71/06* | (2006.01) |

(52) U.S. Cl.

CPC ..... *A63B 69/14* (2013.01); *A63B 31/00* (2013.01); *A63B 2071/0655* (2013.01); *A63B 2230/62* (2013.01)

(58) Field of Classification Search

CPC ..... A63B 69/14; A63B 31/00; A63B 69/12; A61F 5/37–07; A61F 5/05883

See application file for complete search history.

(56) References Cited

U.S. PATENT DOCUMENTS

| | | | | |
|---|---|---|---|---|
| 443,764 | A * | 12/1890 | Hilliard | A61F 5/028 602/19 |
| 5,199,940 | A * | 4/1993 | Morris | A61F 5/055 128/845 |
| 5,868,691 | A * | 2/1999 | Vishnevsky | A61F 5/026 128/845 |
| 9,586,118 | B2 | 3/2017 | Lewin | |
| 10,343,572 | B2 * | 7/2019 | Knapp | B60N 2/882 |

* cited by examiner

*Primary Examiner* — Daniel J Colilla

(57) ABSTRACT

The invention is directed to improve the body alignment in the water of a swimmer. The head band sits on the back of the head allowing the rod to extend down the back to between the shoulder blades. This limits two motions that are undesirable for efficient swimming of the crawl stroke: inappropriate lifting of the head from the neck and over rotating the neck. This lowered neck position and limited neck rotation forces the swimmer to rotate more from the torso in order to clear the water with their mouth and breath and keep the swimmer in an improved body position.

11 Claims, 3 Drawing Sheets

BODY ALIGNMENT TOOL FOR SWIMMERS

BACKGROUND OF THE INVENTION

Field of the Invention

This invention relates to aquatic articles. More specifically, the present invention relates to an aquatic article for teaching proper swimming mechanics.

Background Art

This patent is related to U.S. Pat. No. 9,586,118 and Auto-induced tactile feedback device for training sportspersons.

This patent improves on the previous art by extending the rod down the person's back. Instead of providing tactile feedback the longer, straighter rod prevents the swimmer from lifting the head to the wrong position, rather than just providing tactile feedback. The improved design also prevents over rotation of the head when breathing by limiting the amount of motion in the neck, promoting increased body roll which is desirable for speed in swimming Freestyle (Australian Crawl)

SUMMARY OF THE INVENTION

As the understanding of the physics of swimming has improved the sport has changed the specific body positions used by swimmers. In recent years swimmers have begun to use a more inline head position versus the former head up, with hair at the forehead or hairline of past decades.

This change in body position allows for a greater ability to use the core muscles of the body to power the arm stroke helping making swimmers faster and less fatigued.

Many swimmers both experienced and beginners struggle with this head down position. It is natural to want to watch where you are going rather than keeping the head in line with the torso and looking directly below your body. The Swimming stroke alignment tool presses on the back of the swimmer as they try to raise the head forcing them to keep the spine in correct alignment.

In accordance with the embodiments of the invention, the Body Alignment Tool For Swimmers uses pressure against the back from the base of the rod to prevent the head from rising during swimming. The pressure occurs as a swimmer attempts to hyper extends their neck to look forward and the rigid rod is pushed into the back of the swimmer. Creating a neutral alignment between the head and back. In one embodiment, the rod is straight, reaches down the back to between the shoulder blades, and may have up to 15 degrees of flexion.

In accordance with the embodiments of the invention, the Body Alignment Tool For Swimmers prevents the base of the pole from moving laterally along the back. This reduces the swimmers range of rotation in the neck. This reduced range of motion forces the swimmer to roll the body as a unit and keeps the neck from rolling more than 45 degrees forcing the swimmer to breathe lower to the water.

In accordance with the embodiments of the invention, the Body Alignment Tool For Swimmers is light weight and rides close to the body line allowing for use over an extended time swimming. This extended wear allows the muscles to be retrained to remain in the correct inline position. In addition, the rod has a neutral buoyancy and does not cause the user to sink while swimming.

In accordance with the preferred embodiment of the invention the tool is created from lightweight yet rigid material, preferably 3 mm thick plastic. The headpiece should allow for minimal movement of the neck

BRIEF DESCRIPTION OF THE DRAWINGS

The present invention will now be discussed in further detail below with reference to the accompanying figures in which:

FIG. 1 shows front view of the body alignment tool. The body alignment tool head piece 2, has a Y-shaped area where a head piece sits on the back of a user's head. Rod 3 can be made a different length rod so that the body alignment tool can be used by users of different heights. Rod 3 has a 4 two slot opening where and optional strap may be threaded through 4. In an alternative embodiment of the invention the rod 3 is adjustable in length so that the body alignment tool can be used by users of different height swimmers. The strap 5, while not necessary for the function of the body alignment tool may make it more comfortable for swimmers using the tool over greater distances. The strap 5 is held closed by a clip base 6 and clip 7 parts. The head piece 2 is meant to slide under a bathing cap to keep it in place.

The preferred material for production of the body alignment tool is a 3 mm thick molded plastic, making the piece light and buoyant. Persons skilled in the art will recognize that many variations of details and materials are possible.

Figure 1:
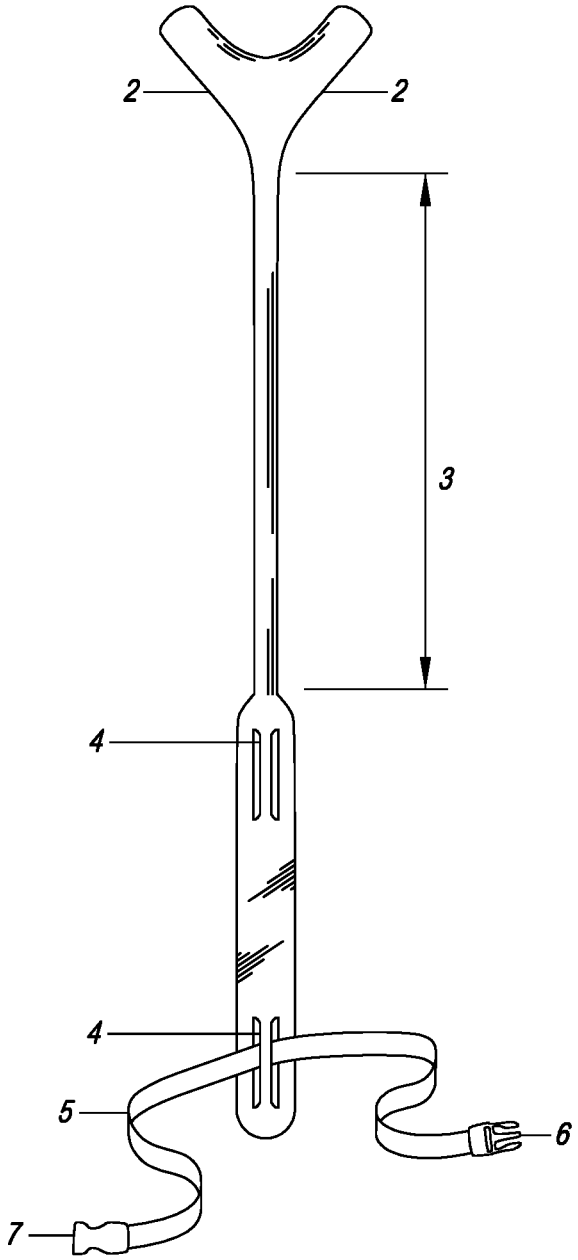
FIG. 1 shows a front view of the tool.
Figure 2:
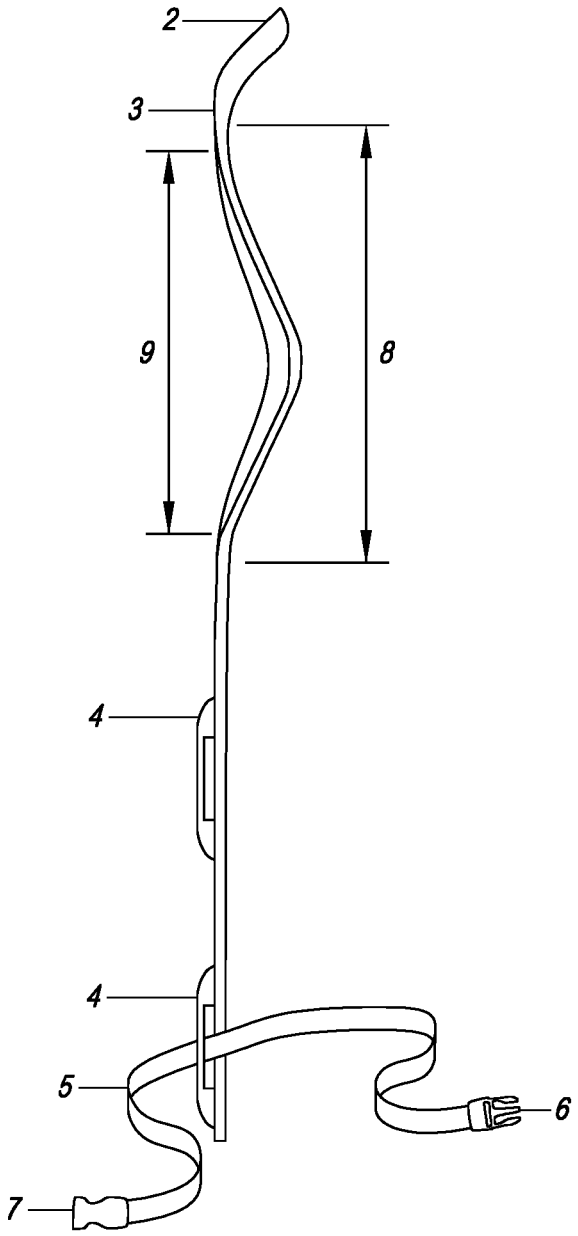
FIG. 2 shows a side view of the tool.

FIG. 2 shows the side view of the body alignment tool. The side view show that the head piece 2 is curved for a close fit on the back of the head, rod 3 has a curve 8 and 9 where the rod fits along the base of the skull. This curve allows the rod 3 to sit closer to the user's body. In addition to the curve the rod 3 has a thickened area 9 to help decrease deflection. This shows slots 4 for strap 5 which can be close with clip 5 and clip base 6 for a snug but nonbinding fit.

Figure 3:
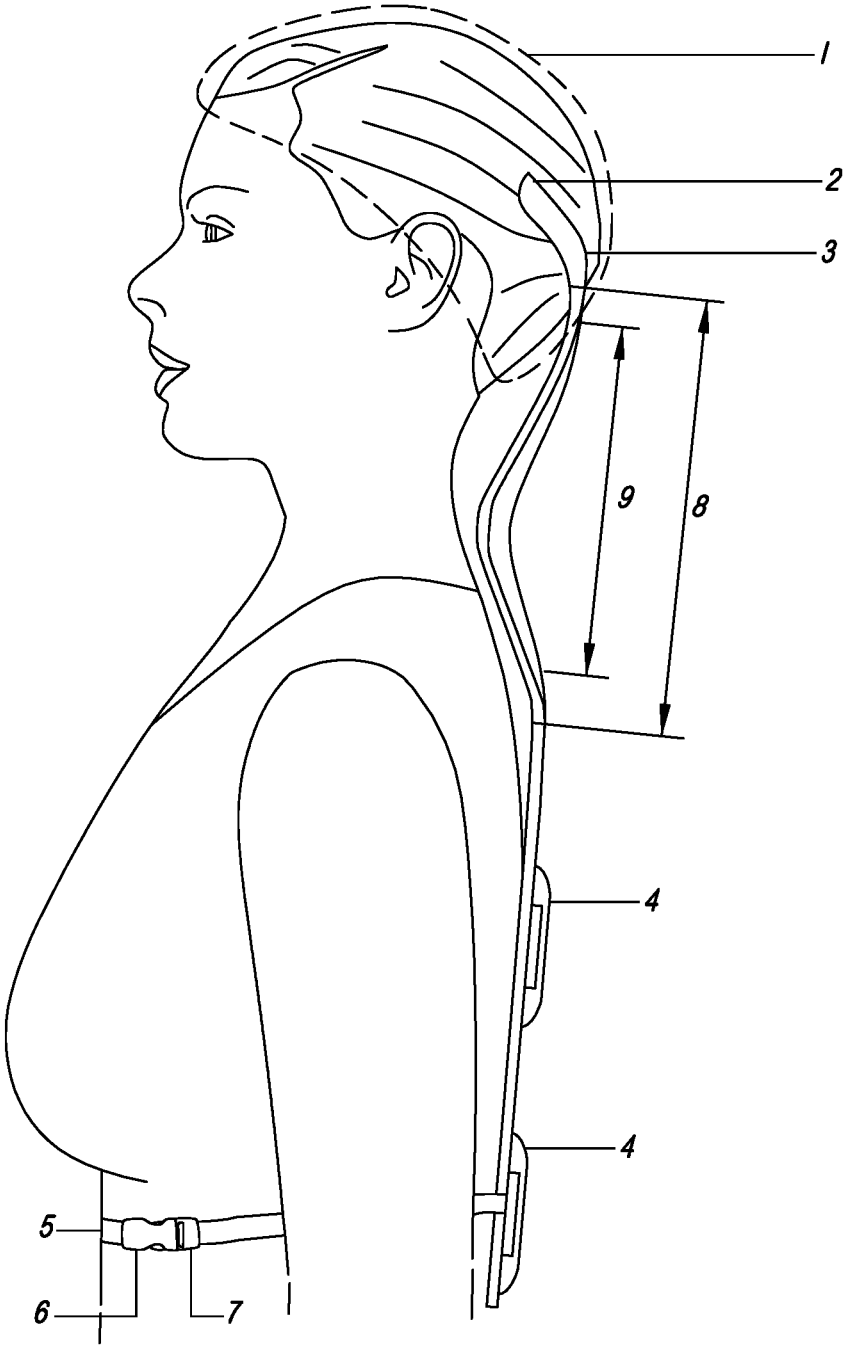
FIG. 3 shows the tool as it would fit on a person. Detailed Description of the Preferred Embodiments The invention herein described is a unique concept of a tool for body alignment when swimming. The disclosed body alignment tool provides physical resistance to correct three common swimming errors. Said tool prevents upward extension of the neck, over rotation of the neck and promotes increased torso roll.

FIG. 3 shows the body alignment tool worn by a user. The head piece is worn on a user's head with widened Y shape head piece 2 sitting the back of the head, is held in place by a bathing cap. The curve 8 in the rod 3 sits in the curve of the neck. The rod 3 has a strap slots 4 at an opposite end of the rod 3 of the head piece, and with increased structural support 9.

A strap 5 passes through either strap slot 4. The strap 5 has two ends one being a clip base 6 and a locking clip 7.

The strap 5 secures the body alignment tool around the chest to optionally hold the bottom of the body alignment tool in a stable location on the back of the user.

Method of Use:

A method of using the body alignment tool includes attaching a head piece to a swimmer. The head piece having a rod pressing into a mid-back of the swimmer training the swimmer to maintain proper alignment while swimming.

In an alternative embodiment of the invention the rod is either adjustable in length or replaceable with a rod of a different length so that the rod or the rod of a different length is presses into the mid-back of the swimmer.

In an alternative embodiment of the invention the rod has a strap passing through a strap slot at an end of the rod opposite the head piece further aligning the head piece and rod along a centerline of a back of the swimmer.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A device to maintain body alignment while swimming, comprising:

a. a head piece;

b. the head piece formed as a single piece with a rod;

c. the head piece wraps around a back of a head of a user forming a snug fit close to the head or the user;

d. the rod extends from a middle of the user's head to a mid-back of the user, wherein the rod has a neutral buoyancy and does not cause the user to sink while swimming.

2. The device to maintain body alignment while swimming of claim 1, wherein the rod prevents the user's head from lifting while swimming so as to keep the user's head in alignment while swimming and retrain the user while swimming.

3. The device to maintain body alignment while swimming of claim 1, further comprising:

a. a strap slot at an opposite end of the rod from the head piece;

b. a strap passing through the strap slot;

c. wherein the strap has a clasp allowing the device to maintain body alignment to the mid-back of the user.

4. The device to maintain body alignment while swimming of claim 1, wherein the strap is adjustable to allow for a snug fit.

5. A device to maintain body alignment while swimming, comprising:

a. a head piece;

b. the head piece attached to a rod;

c. the head piece wraps around a back of a head of a user forming a snug fit close to the head or the user;

d. the rod extends from a middle of the user's head to a mid-back of the user, wherein the rod has a neutral buoyancy and does not cause the user to sink while swimming.

6. The device to maintain body alignment while swimming of claim 5, wherein the rod prevents the user's head from lifting while swimming so as to keep the user's head in alignment while swimming and retrain the user while swimming.

7. The device to maintain body alignment while swimming of claim 5, wherein the rod is interchangeable for a rod of a different length based on a height of the user.

8. The device to maintain body alignment while swimming of claim 5, further comprising:

a. a strap slot at an opposite end of the rod from the head piece;

b. a strap passing through the strap slot;

c. wherein the strap has a clasp allowing the device to maintain body alignment to the mid-back of the user.

9. The device to maintain body alignment while swimming of claim 5, wherein the strap is adjustable to allow for a snug fit.

10. A method for training body alignment of a swimmer, comprising:

a. attaching a chest strap of a swimming training apparatus along the midline of the swimmer, wherein the training apparatus comprises a rod traversing between the back of the head and mid-back of the swimmer, and said rod having a neutral buoyancy, and having the chest strap positioned at a dorsal end and a headpiece positioned at the cranial end; and b. swimming with the training apparatus wherein the rod applies pressure to the swimmer back in response to the swimmer hyper extending their neck to look forward.

11. The method for training body alignment of a swimmer of claim 10, wherein the rod is replaceable with a rod of a different length.

* * * * *